US008210103B2

(12) United States Patent
Gagnon et al.

(10) Patent No.: US 8,210,103 B2
(45) Date of Patent: Jul. 3, 2012

(54) APPARATUS AND METHOD FOR SUPPLYING RIBBONS TO A FORMER

(75) Inventors: David John Gagnon, Somersworth, NH (US); David Elliot Whitten, Barrington, NH (US); Thomas Thibault, Saco, ME (US)

(73) Assignee: Goss International Americas, Inc., Durham, NH (US)

( * ) Notice: Subject to any disclaimer, the term of this patent is extended or adjusted under 35 U.S.C. 154(b) by 1076 days.

(21) Appl. No.: 12/154,500

(22) Filed: May 23, 2008

(65) Prior Publication Data

US 2009/0290924 A1 Nov. 26, 2009

(51) Int. Cl.
*B41F 13/56* (2006.01)
*B41F 5/04* (2006.01)
*B41F 13/58* (2006.01)

(52) U.S. Cl. ..... 101/227; 101/219; 101/480; 270/20.1; 270/10; 270/43; 270/52.08; 226/174

(58) Field of Classification Search ..... 101/480, 101/228, 227, 219; 270/20.1, 21.1, 5.01, 270/5.02, 10, 41, 43, 52.07, 52.08; 226/49–51, 226/110, 174, 178, 181
See application file for complete search history.

(56) References Cited

U.S. PATENT DOCUMENTS

| | | | | |
|---|---|---|---|---|
| 2,746,748 | A * | 5/1956 | Harless | 270/41 |
| 4,495,582 | A | 1/1985 | Dessert et al. | |
| 4,545,782 | A | 10/1985 | Niemiro et al. | |
| 5,309,834 | A * | 5/1994 | Koch | 101/248 |
| 5,558,318 | A | 9/1996 | Crowley et al. | |
| 5,676,056 | A | 10/1997 | Stein et al. | |
| 5,685,528 | A | 11/1997 | Weis | |
| 5,775,222 | A | 7/1998 | Zweifel et al. | |
| 6,161,477 | A * | 12/2000 | Hara et al. | 101/219 |
| 6,244,593 | B1 | 6/2001 | Schaefer et al. | |
| 6,298,781 | B1 * | 10/2001 | Dufour | 101/483 |
| 6,532,356 | B2 * | 3/2003 | Taguchi | 399/384 |
| 6,578,479 | B2 | 6/2003 | Schramm | |
| 6,786,150 | B2 | 9/2004 | Drew et al. | |
| 6,899,026 | B2 | 5/2005 | Weis | |
| 7,143,692 | B2 * | 12/2006 | Schmitt et al. | 101/227 |
| 7,191,703 | B2 | 3/2007 | Dilling | |
| 7,404,349 | B1 * | 7/2008 | Fiske et al. | 83/236 |
| 2003/0098798 | A1 | 5/2003 | Kato | |
| 2006/0157924 | A1 | 7/2006 | Elkinson et al. | |

* cited by examiner

*Primary Examiner* — Judy Nguyen
*Assistant Examiner* — Marissa Ferguson Samreth
(74) *Attorney, Agent, or Firm* — Davidson, Davidson & Kappel, LLC

(57) ABSTRACT

A folder superstructure is provided including a lead roll, a nip roll biasing the lead roll, and a frame supporting the lead roll and the nip roll. The frame is selectively movable between a first position where the lead roll and the nip roll act on a first web ribbon and a second position where the lead roll and the nip roll act on a second web ribbon. A method for folding printed webs is also provided.

18 Claims, 4 Drawing Sheets

APPARATUS AND METHOD FOR SUPPLYING RIBBONS TO A FORMER

BACKGROUND OF INVENTION

The present invention relates generally to printing presses and more specifically to a ribbon transport for a folder superstructure.

U.S. Pat. No. 6,578,479 discloses a method of operating a web-fed rotary printing machine. A web, on the web path through the rotary printing machine, runs successively through a first pull unit upstream of the printing unit, a sixth pull unit embodied by the cooling unit, and a second pull unit upstream of the turner bars. A slitting device divides the web into two web streams, each of which passes through one of respective third pull devices. A fourth pull device is located upstream of the folding former, and a fifth pull device is located downstream of the folding former.

U.S. Pat. No. 7,191,704 discloses a web-fed press including a plurality of reel carriers and a plurality of groups of printing units. Following the printing of the printing material in the printing units, the printing material is supplied to a folder superstructure.

U.S. Pat. Pub. 2006/0157924 discloses a folder superstructure in which ribbon bundles formed from printed webs pass over pull rolls, then past gathering rolls to an RTF.

BRIEF SUMMARY OF THE INVENTION

A folder superstructure is provided including a lead roll, a nip roll biasing the lead roll, and a frame supporting the lead roll and the nip roll. The frame is selectively movable between a first position where the lead roll and the nip roll act on a first web ribbon and a second position where the lead roll and the nip roll act on a second web ribbon.

A method for folding printed webs is provided. The method includes folding a first web using a lead roll and nip roll in a first position, moving the lead roll and nip roll to a second position, and folding a second web using the lead roll and nip roll.

BRIEF DESCRIPTION OF THE DRAWINGS

The present invention is described below by reference to the following drawing, in which.

DETAILED DESCRIPTION

In a web printing press a web is commonly slit into a number of ribbons. The ribbons are translated towards a former by multiple rolls and the former acts to longitudinally fold these ribbon bundles. The rolls may translate the ribbons by acting on the ribbons alone or in pairs, where often one roll in the pair is driven and in turn rotates the other roll. As shown in the prior art, ribbons normally are only fed to a former by a printing unit or printing units from one direction. If the need arises to change to a printing unit or units located in a different direction, additional driven motors or rolls would need to be added to accept ribbons from that new direction.

Figure 1:
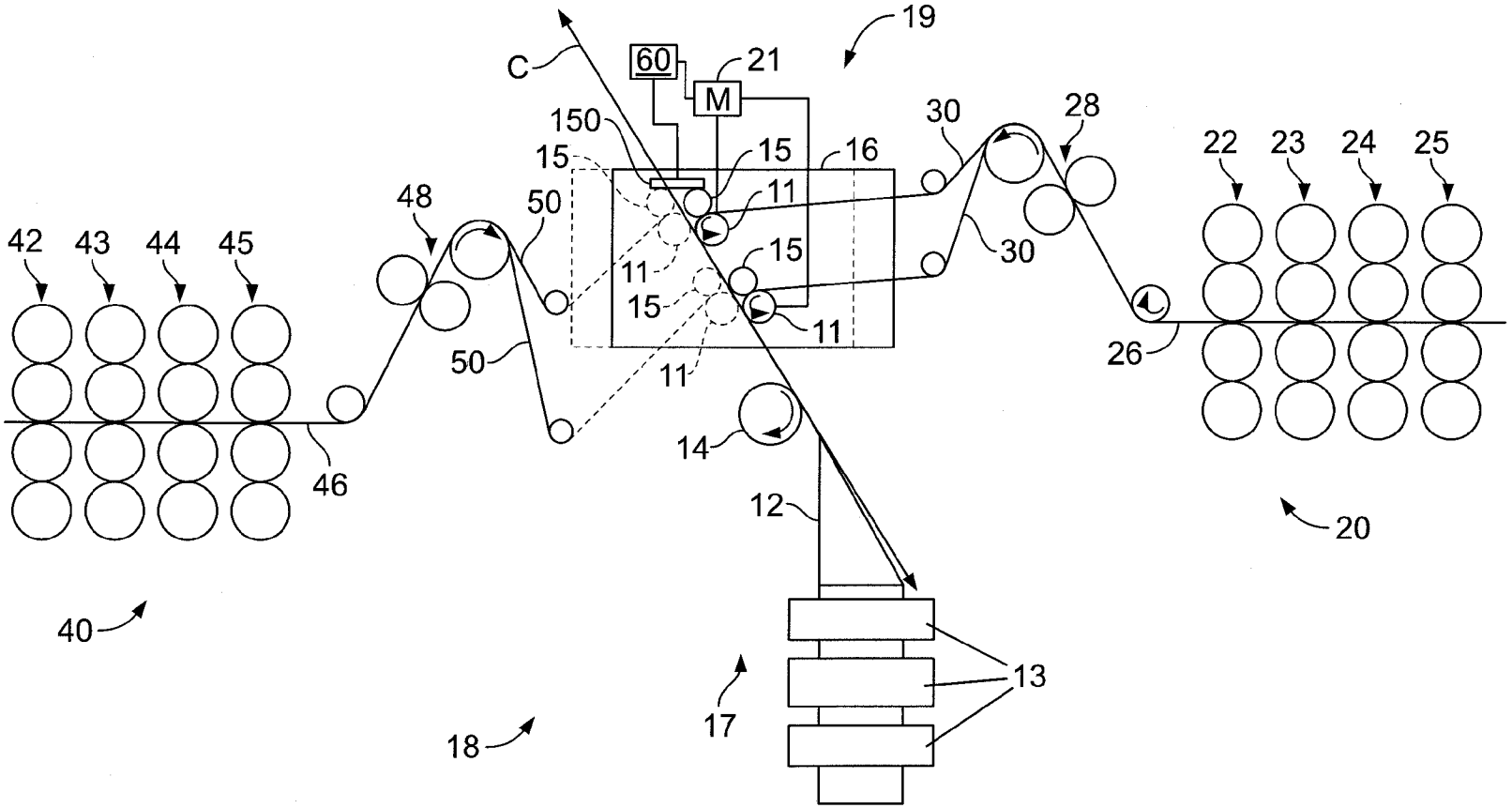
FIG. 1 shows a schematic side view of a printing device according to an embodiment of the present invention.

FIG. 1 shows a side view of a printing device 18 according to an embodiment of the present invention. Printing system 18 includes a first printing press 20, a second printing press 40, and a folder superstructure 17 that can work with each printing press 20, 40. Folder superstructure 17 may include ribbon transport system 19, a gathering roll 14 and a former 12. Ribbon transport system 19 may include lead rolls 11, nip rolls 15, a movable frame 16 and a motor 21 driving leads 11. In an alternative embodiment lead rolls 11 may be driven by separate motors. Ribbon transport system 19 either acts on first web ribbons 30 printed by first printing press 20 or second web ribbons 50 printed by second printing press 40.

Figure 2:
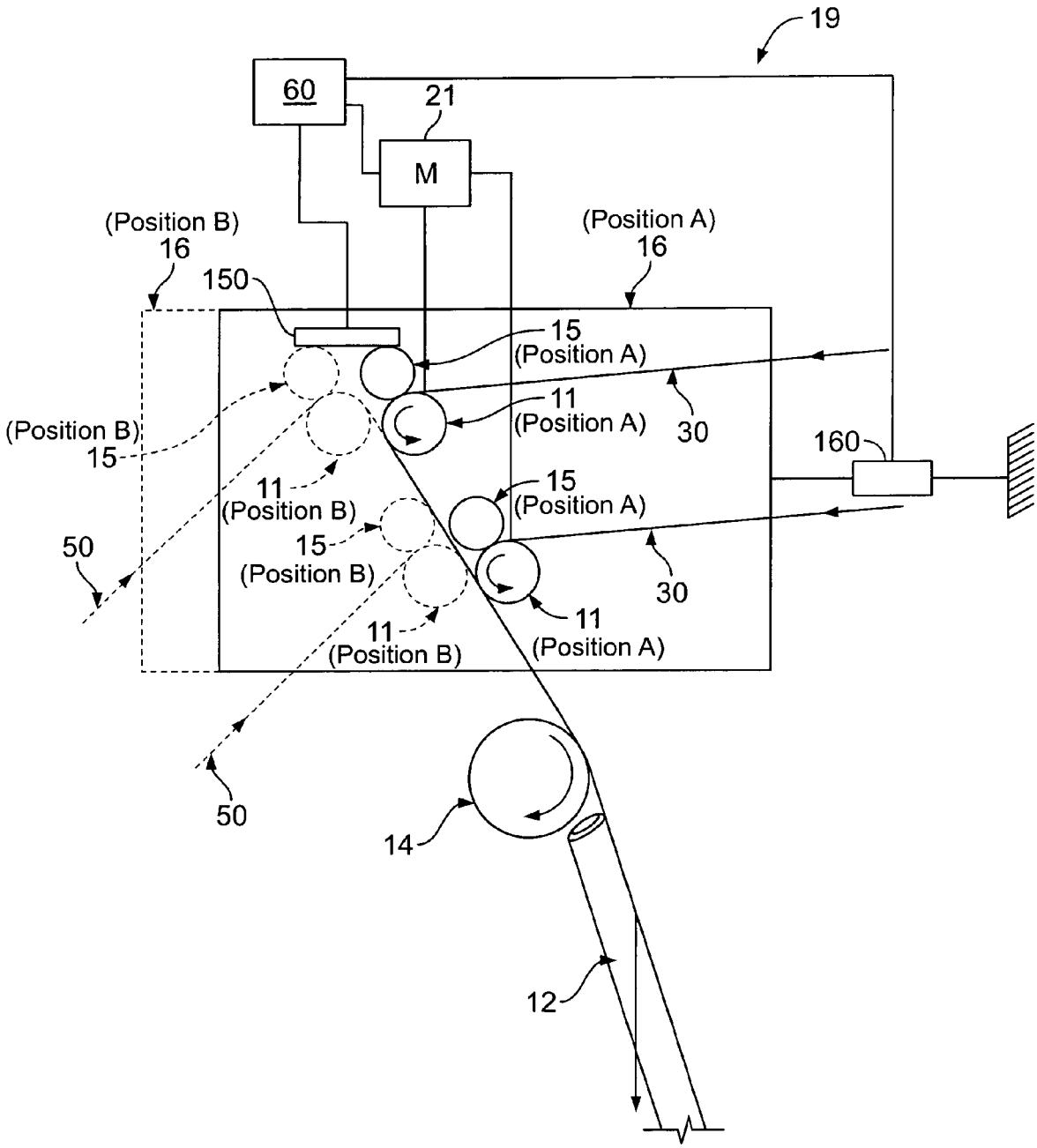
FIG. 2 shows an enlarged side view of a folder superstructure shown in FIG. 1 including a linear motion device 160.

FIG. 1 shows ribbon transport system 19 in a first position indicated by solid lines and indicated as position "A" in FIG. 2, acting on first web ribbons 30. FIG. 1 also shows dotted lines representing how ribbon transport system 19 would be positioned in a second position, indicated as position "B" in FIG. 2, when ribbon transport system 19 acts on second web ribbons 50. Lead rolls 11, nip rolls 15, and motor 21 can be mounted on movable frame 16. Frame 16 is configured to move lead rolls 11, nip rolls 15 and motor 21 between at least the first position, position "A," and the second position, position "B."

Figure 3:
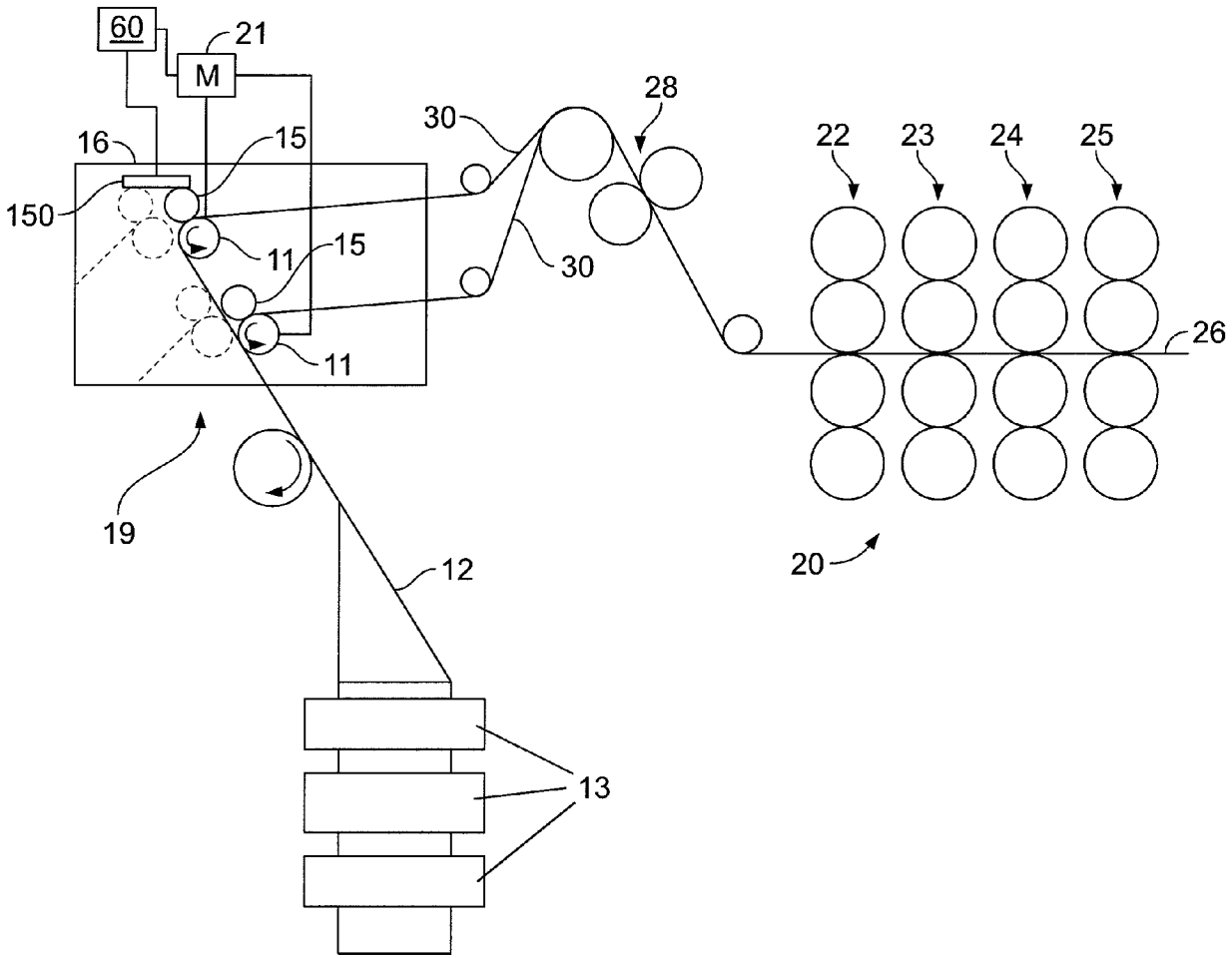
FIG. 3 shows an enlarged side view of a first printing press shown in FIG. 1.

As shown in FIGS. 1 and 3, first printing press 20 includes a plurality of first printing units 22, 23, 24, 25. First printing units 22, 23, 24, 25 print images on a first web 26 as web 26 passes through printing units 22, 23, 24, 25. First web 26 is then slit by a first slitting device 28 into two or more first web ribbons 30. First web ribbons 30 then enter ribbon transport system 19 of folder superstructure 17. First web ribbons 30 are translated to gathering roll 14 by lead rolls 11 and nip rolls 15. First web ribbons 30 are translated by being biased against lead rolls 11 by nip rolls 15 as lead rolls 11 are rotated counter clockwise by motor 21. Gathering roll 14 then directs first web ribbons 30 to former 12, which longitudinally folds first web ribbons 30. After first web ribbons 30 are longitudinally folded, transport rolls 13 direct first web ribbons 30 away from former 12 and possibly toward additional post-press equipment, such as folders, trimmers, collators, perforators, stitchers, inserters, or any other post-press equipment found in a lithographic printing press.

Lead rolls 11, nip rolls 15, and gathering roll 14 only act on first web ribbons 30 when lead rolls 11 and nip rolls 15 are located in first position, position "A." In position "A", lead rolls 11 are positioned on the right side of an axis C, thus allowing lead rolls 11, nip rolls 15 and gathering roll 14 to direct first web ribbons 30 from printing units 22, 23, 24, 25 to former 12 for longitudinal folding along axis C.

Figure 4:
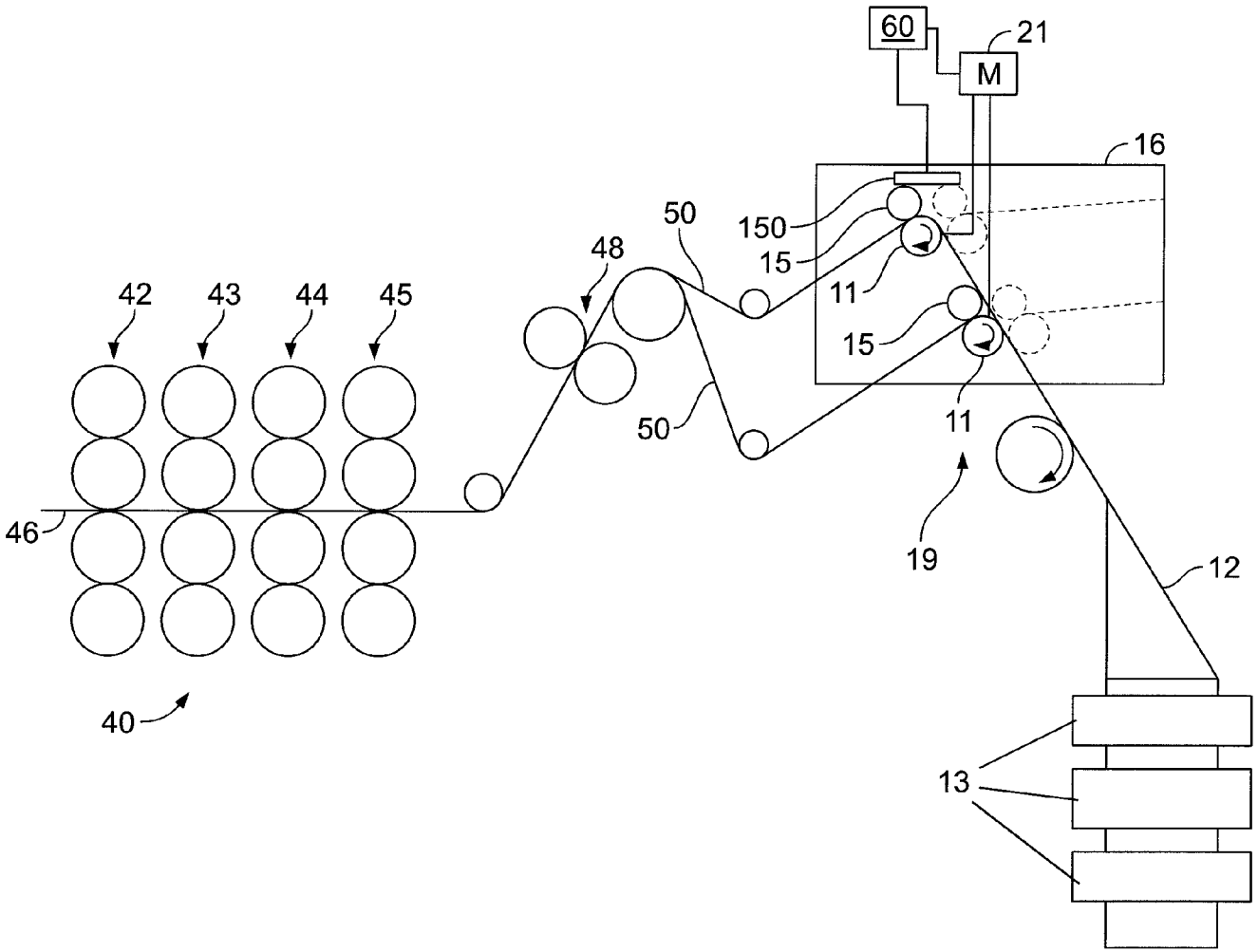
FIG. 4 shows an enlarged side view of a second printing press shown in FIG. 1.

As shown in FIGS. 1 and 4, second printing press 40 includes a plurality of second printing units 42, 43, 44, 45. A second web 46 is fed through second printing units 42, 43, 44, 45. Second printing units 42, 43, 44, 45 print images on second web 46 as web 46 passes through printing units 42, 43, 44, 45. Second web 46 is then slit by a second slitting device 48 into two or more second web ribbons 50. Second web ribbons 50 are then directed to ribbon transport system 19 of folder superstructure 17. Lead rolls 11 and nip rolls 15 then translate second web ribbons 50 to gathering roll 14. Second web ribbons 50 are translated by being biased against lead rolls 11 by nip rolls 15 as lead rolls 11 are rotated clockwise by motor 21. Gathering roll 14 then directs second web ribbons 50 to former 12, which longitudinally folds second web ribbons 50. After second web ribbons 50 are longitudinally folded, transport rolls 13 direct second web ribbons 50 away from former 12 and possibly toward additional post-press equipment, such as folders, trimmers, collators, perforators, stitchers, inserters, or any other post-press equipment found in a lithographic printing press.

Lead rolls 11, nip rolls 15, and gathering roll 14 only act on second web ribbons 50 when lead rolls 11 and nip rolls 15 are located in second position, position "B." In position "B", lead rolls 11 are positioned on the left side of an axis C, as shown in FIG. 1. This allows lead rolls 11, nip rolls 15 and gathering roll 14 to pull second web ribbons 50 from second printing press 40, along axis C to former 12 for longitudinal folding.

A sensing element 150, for example a limit switch or proximity sensor, may be used to detect a position of ribbon transport system 19 by detecting a position of one or more lead rolls, a position of one or more nip rolls 15 or a position of movable frame 16. A controller 60 may receive signals from sensing element 150 and direct motor 21 to rotate lead rolls 11 based on the position of ribbon transport system 19. Motor 21 may be mounted directly on movable frame 16.

FIG. 2 shows an enlarged schematic side view of ribbon transport system 19 shown in FIG. 1. FIG. 2 depicts position "A" and position "B." Ribbon transport system 19 can be moved between position "A" and position "B," thus allowing former 12 to accept web ribbons 30 or 50 from printing presses 20 or 40, respectively, without requiring another set of lead rolls, nip rolls, or motor. To change the source of web ribbons 30 or 50 from first printing press 20 to second printing press 40 (FIG. 1), frame 16 is moved from position "A" to position "B." To switch back to first printing press 20 from second printing press 40, movable frame 16 is moved from position "B" to position "A". Frame 16 may be moved between the printing positions by a linear motion device 160; for example: pneumatic cylinder, hydraulic cylinder, linear motor, motor/lead screw arrangement; or by manual movement by a machine operator. Frame 16 may also be held in place in a printing position by a stabilizing or locking mechanism.

In a preferred embodiment, when driven lead rolls 11 are in position to pull web ribbons 30 or 50 from one of the printing presses 20, 40, sensing element 150 can be used to determine whether ribbon transport system 19 is in position "A" or position "B." Sensing element 150 sends a signal to controller 60 which automatically determines a corresponding direction lead rolls 11 need to be rotated and causes motor 21 to rotate lead rolls 11 in the corresponding direction. For example, if movable frame 16 is in position "A", sensing element 150 informs controller 60 and controller 60 may cause lead rolls 11 to be rotated counter clockwise by motor 21. If frame 16 is in position "B", sensing element 150 can inform controller 60 and controller 60 can cause the lead rolls 11 to be rotated clockwise by motor 21. Controller 160 may also control linear motion device 160.

FIG. 3 shows an enlarged side view of first printing press 20 shown in FIG. 1, with ribbon transport system 19 in first transport position. Movable frame 16, along with lead rolls 11 and nip rolls 15, is arranged in position "A." Printing units 22, 23, 24, 25 print images on web 26, which is cut first slitting device 28 into first web ribbons 30. Lead rolls 11 and nip rolls 15 are positioned to translate first web ribbons 30 to former 12. Controller 60 receives a signal from sensing element 150 indicating ribbon transport system is in position "A" and motor 21 rotates lead rolls 11 counterclockwise.

FIG. 4 shows an enlarged side view of second printing press 40 shown in FIG. 1, with ribbon transport system 19 in second transport position. Movable frame 16 is arranged in position "B." Printing units 42, 43, 44, 45 print images on web 46, which is cut first slitting device 48 into first web ribbons 50. Lead rolls 11 and nip rolls 15 are positioned to translate first web ribbons 50 to former 12. Controller 60 receives a signal from sensing element 150 indicating ribbon transport system is in position "B" and motor 21 rotates lead rolls 11 clockwise.

Although the embodiment shown in FIGS. 1 to 4 show ribbon transport system 19 in a horizontal alignment, the present invention is not limited to such an alignment. For example, ribbon transport system 19 may be arranged so that frame 16 slides vertically between positions "A" and "B," or even so that frame 16 is translated horizontally and vertically. Such an arrangement may be necessary, depending upon the arrangement of first printing press 20 and second printing press 40, and former 12.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A folder superstructure comprising:

a lead roll;

a nip roll biasing the lead roll;

a frame supporting the lead roll and the nip roll selectively movable between a first position where the lead roll and the nip roll act on a first web ribbon and a second position where the lead roll and the nip roll act on a second web ribbon.

2. The folder superstructure recited in claim 1 further comprising a former positioned downstream of the lead roll and the nip roll.

3. The folder superstructure recited in claim 1 further comprising a gathering roll positioned downstream of the lead roll and the nip roll.

4. The folder superstructure recited in claim 3 further comprising a former downstream of the gathering roll, the gathering roll directing the first web ribbons from the lead roll and the nip roll to the former when the frame is in the first position and directing the second web ribbons from the lead roll and the nip roll to the former when the frame is in the second position.

5. The folder superstructure recited in claim 1 further comprising a linear motion device moving the frame between the first position and the second position.

6. The folder superstructure recited in claim 1 further comprising a motor driving at least one of the lead roll and nip roll.

7. The folder superstructure recited in claim 6 further comprising a controller controlling the motor.

8. The folder superstructure recited in claim 6 wherein the motor drives at least one of the lead roll and the nip roll in a first direction when the frame is in the first position and drives at least one of the lead roll and the nip roll in a second direction when the frame is in the second position.

9. The folder superstructure recited in claim 1 further comprising a sensing element detecting a position of at least one of the lead roll, the nip roll, or the movable frame.

10. The folder superstructure recited in claim 9 wherein the sensing element informs the controller of the position of the at least one of the lead roll, the nip roll or the movable frame.

11. The folder superstructure recited in claim 1 further comprising:

a sensing element detecting whether the frame is in a first position or a second position;

a motor driving the lead roll;

a linear motion device moving the frame between the first position and the second position; and a controller receiving signals from the sensing element and controlling the motor and linear motion device.

12. The folder superstructure recited in claim 11 wherein the controller controls the motor to rotate the lead roll in a first direction when the frame is in the first position and controls the motor to rotate the lead roll in a second direction opposite the first direction when the frame is in the second position.

13. A printing device comprising:

a first printing press;

a second printing press; and the folder superstructure as recited in claim 1 located between the first printing press and the second printing press.

14. The printing device recited in claim 13 wherein the first web ribbon is printed on by the first printing press when the frame is in the first position and the second web ribbon is printed on by the second printing press when the frame is in the second position.

15. A method for folding printed webs comprising:

folding a first web using a lead roll and nip roll in a first position;

moving the lead roll and nip roll to a second position; and folding a second web using the lead roll and nip roll, the lead roll and nip roll being in the second position during the folding of the second web.

16. The method recited in claim 15 wherein the folding the first web includes longitudinally folding the first web with a former downstream of the lead roll and the nip roll and the folding the second web includes longitudinally folding the second web with the former.

17. The method recited in claim 15 wherein the lead roll and nip roll are supported by a frame, the method further comprising:

detecting a position of at least one of the lead roll, the nip roll and the frame to determine whether the lead roll and nip roll are in the first position or the second position; and rotating at least one of the lead roll and the nip roll in a first direction when the lead roll and nip roll are in the first position and rotating at least one of the lead roll and the nip roll in a second direction opposite the first direction when the lead roll and nip roll are in the second position.

18. The method as recited in claim 17 wherein at least one of the lead roll and the nip roll are rotated in the first direction during the folding the first web and in the second direction during the folding the second web.

* * * * *